US005961120A

United States Patent [19]

Tarasov et al.

[11] Patent Number: 5,961,120

[45] Date of Patent: Oct. 5, 1999

[54] CASINO GAMES AND APPARATUS THEREFOR

[75] Inventors: Artem Michaeilovich Tarasov; Vitali Yrievich Kozlikin, both of London, United Kingdom

[73] Assignee: Kenmore Services Limited, London, United Kingdom

[21] Appl. No.: 08/986,213

[22] Filed: Dec. 5, 1997

[30] Foreign Application Priority Data

Dec. 10, 1996 [GB] United Kingdom ..... 9625591

[51] Int. Cl.[6] ..... A63F 1/00

[52] U.S. Cl. ..... 273/309; 273/296; 273/149 R

[58] Field of Search ..... 273/292, 148 R, 273/309, 149 R, 296

[56] References Cited

U.S. PATENT DOCUMENTS 5,735,524 4/1998 Wisted ..... 273/292 X 5,752,702 5/1998 McDoniel ..... 273/292

5,758,878 6/1998 Brown ..... 273/292 X 5,762,340 6/1998 Feola ..... 273/292

*Primary Examiner*—William E. Stoll

*Attorney, Agent, or Firm*—Richard M. Goldberg

[57] ABSTRACT

A game includes an arcuate shaped table which is provided with a croupier's station at or near a focal point of the table and a plurality of players' stations arranged around an outer periphery of the table; and two sets of playing cards, a first set for use by the croupier and a second set to be used by each player, the croupier's cards each having one side marked with a number from '1' to '25' and an opposite side having no indication of that number and each player's card having a number between '1' and '25' on both sides of the card.

12 Claims, 4 Drawing Sheets

CASINO GAMES AND APPARATUS THEREFOR

INTRODUCTION

The present invention relates to casino games and apparatus therefor,

The present invention is concerned with providing a casino game which will be attractive to casino players because of its novelty and variety of interest

BACKGROUND TO THE INVENTION

It is important with a casino game, as distinct from one which is played privately or domestically, that it should be dynamic and only last a relatively short time. typically only several minutes. It is also important that it should be easy for new players to learn the game and to easily see what is happening when viewing the game in order to create interest and excitement.

There are known non-casino games which essentially involve the successive random selection by the person running the game of individual numbers front a master set of numbers or pool of numbers from which selected numbers are to be matched against different sub-sets of numbers held or purchased by individual players, the winner being the player whose sub-set is first completed by the successive random selection. Typical examples of such games are those known as 'Bingo' and 'Lotto'. Such a game is referred to hereinafter as a game of the kind described, The equipment used to play such games can take a variety of forms. Typically each player would hold or purchase a card, or cards, each one of which would carry the different sub-set of numbers. The physical arrangement of the numbers on the card can distinguish one form of this kind of game from another.

The equipment for randomly selecting the successive numbers is known to take a number of forms ranging from a simple manual selection of a token from a reservoir of such tokens, each token carrying one unique number, through to a computerised system for randomly selecting the numbers. In order to add interest to such games, as well as the main prize being given to the player whose sub-set of numbers is first completed, a variety of intermediate further prizes may be awarded to the player who first completes a sub-sub-set of numbers on their card, such as the first horizontal row of numbers, for example.

The present invention is concerned with providing a novel casino game which to some extent is based on the above discussed type of game but has other characteristics which make it particularly suitable for playing by casino players.

SUMMARY OF THE INVENTION

According to the present invention a game of the kind described is characterized in that it is played on a generally horse shoe or arcuate shaped table which table is provided with a croupier's station at or near the focal point of the table and a plurality of player's stations arranged substantially around the outer periphery of the table.

The table can be further characterised by distinctive features which will be described later with reference to a specific embodiment of the invention.

BRIEF DESCRIPTION OF THE DRAWINGS

How the invention may be carried out will now be described by way of example only and with reference to the accompanying drawings in which.

THE PLAYING TABLE

The apparatus used to play the game will first be described and then the way in which the game is played.

Figure 1:
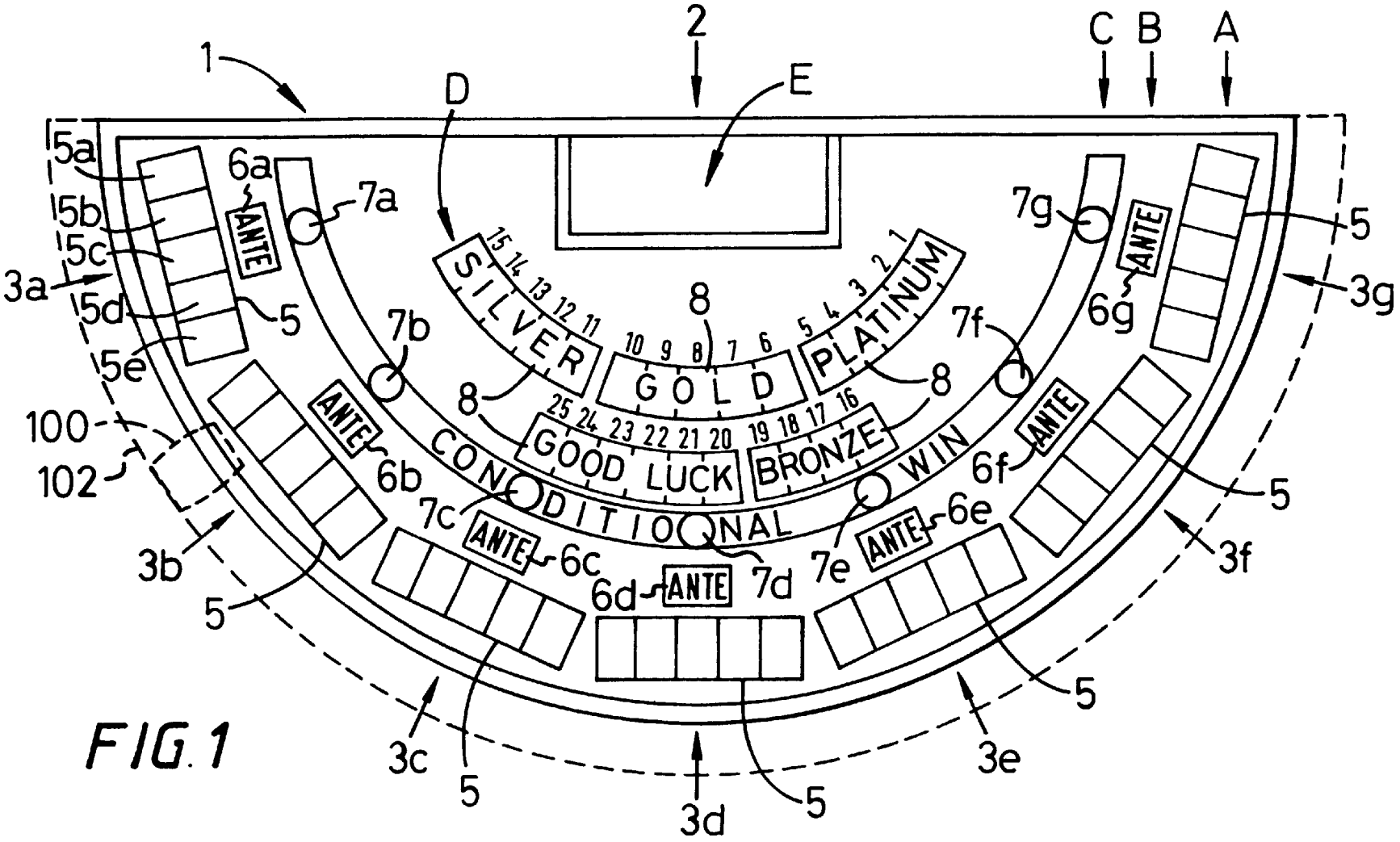
FIGS. 1 to 3 are plan views of two designs/layouts of table upon which the game according to the present invention is played.
Figure 2:
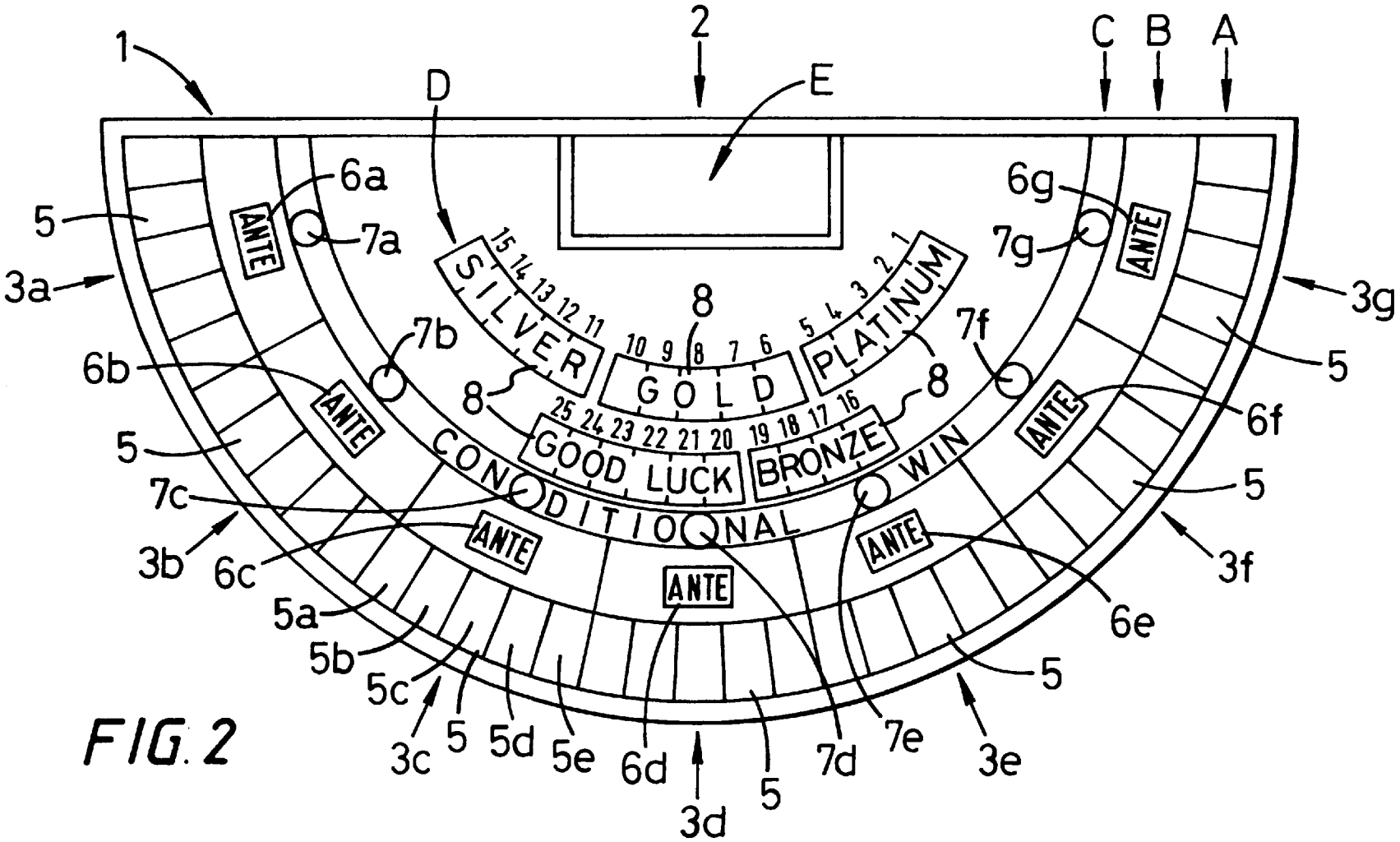
Figure 3:
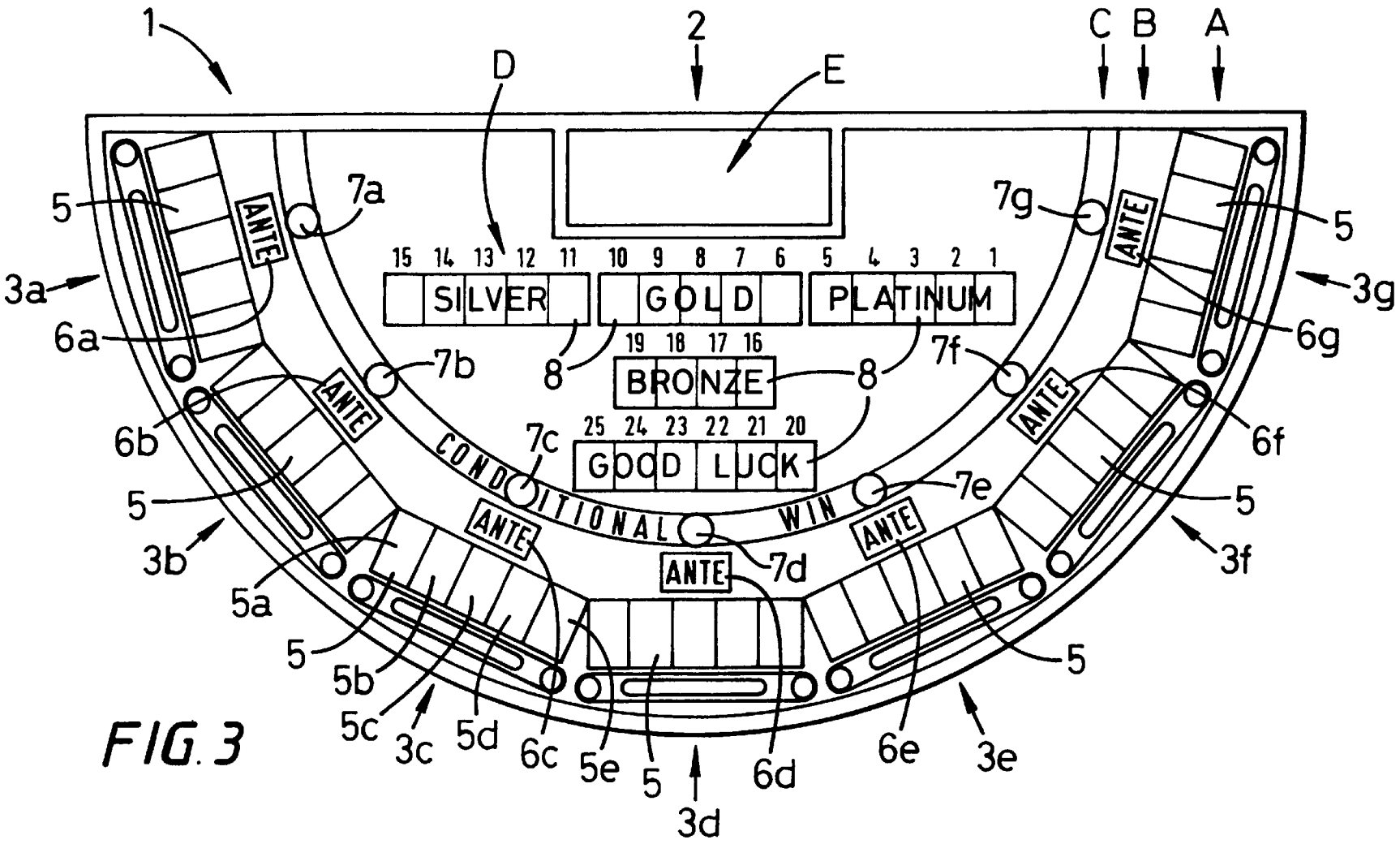
Figure 4:
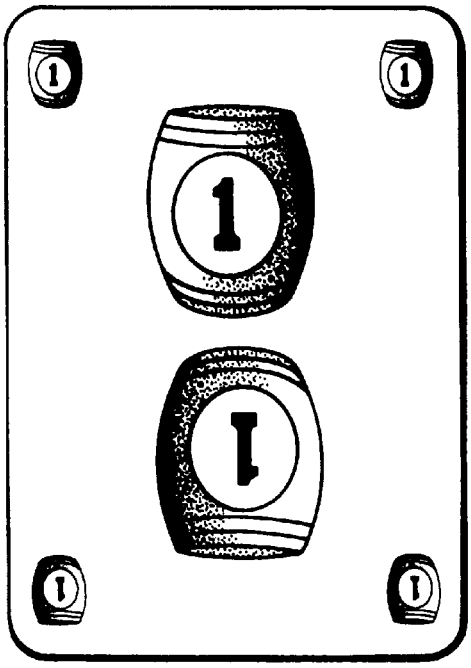
FIGS. 4 and 5 show the front and back faces of a typical playing card.
Figure 5:
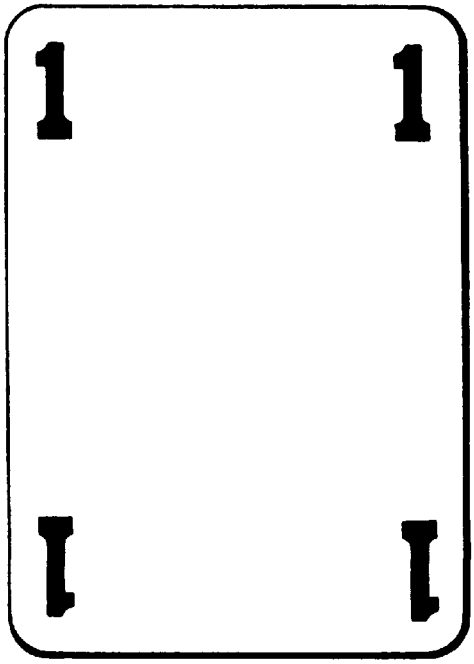

FIGS. 1 to 3 show three possible table designs/layouts, the equivalent elements of which have been indicated by the same reference numerals. The playing table 1, is substantially semi-circular in shape but it can be any shape which enables a croupier to be positioned at a focal point from which he/she can easily reach all the players' stations.

In these embodiments the croupier is notionally positioned at the focal point 2 and the table 1 is provided with seven playing stations 3*a* to 3*g* respectively arranged around the outer arcuate track A of the table. Clearly the number of players' stations could be varied depending on the dimensions of the table.

Each player's playing station 3 consists essentially of five boxes or spots 5*a* to 5*e* respectively, each with numbers on them which are designed to take initially the cards which are dealt out. The boxes 5 are located on the radially outermost track or zone A. Immediately radially inwardly from the zoneA is zone B which contains seven spots 6*a* to 6*g*, respectively, one for each player, upon which the player can place their stakes or bets in the form of the usual casino betting chips. In this embodiment the spots 6 are rectangular shaped and carry the word 'ANTE' but could be other shapes.

Immediately inwardly of the arcuate track or zone B is a third arcuate track or zone C which contains seven spots 7*a* to 7*g* which relate to a stage in the game whose function in playing the game will be described later and referred to as a 'CONDITIONAL WIN'; these words being marked on the arcuate track or zone C.

Radially inwardly from the track or zone C is a central zone D which is designed to be used by the croupier. Zone D contains twenty five rectangular boxes which are similar to the boxes 7 all of them being the size of a playing card. These boxes are divided up into five labelled "SILVER", five labelled "GOLD", five labelled "PLATINUM", four labelled "BRONZE: and six labelled "GOOD LUCK". The "PLATINUM" boxes are numbered "1"to "5", the "GOLD" boxes "6" to "10", the "SILVER" boxes "11" to "15", the "BRONZE" boxes "16" to "19" and the "GOOD LUCK" boxes "20" to "25".

Finally, at the centre of the circle of which the semi-circular table is part is a zone E for use by the croupier where he/she can store the betting chips.

ONE METHOD OF PLAY

The way in which the casino game is played will now be described without reference to the various possible pieces of equipment or devices which could be used to achieve this, these being described later.

Essentially the game consists in the croupier dealing out or producing one at a time twenty numbers from a set of twenty five numbers the numbers ranging from '1' to '25' inclusive. i.e. five of these numbers are held back and do not initially form part of the play.

Initially each player will have selected five numbers from the numbers; '1' to '25' as a so-called 'LOT' and placed a stake or bet on them.

Basically in order for a player to win it is necessary for all these five selected numbers to be held or produced by the croupier. Each player may have up to seven 'LOTS' and may also bet on any particular number coming up by placing his stake on that number. In other words the player can bet on either the five numbers or on individual numbers.

Each 'LOT' of five numbers must consist of five different numbers from the main pool of numbers '1' to '25'.

The action of the croupier in introducing or randomly selecting a number is called 'making STEPS'.

As the croupier produces each number in turn the players check to see if any of their 'LOTS' includes the number which has been produced by the croupier in the 'STEP'.

At an intermediate stage in the game a so-called 'conditional' win goes to the player who has a 'LOT' with four numbers coinciding with the numbers produced by the croupier. This conditional win is called a 'HOUSE' and only becomes effective if the player subsequently wins the whole round. If the player forms a 'HOUSE' then the croupier is obliged to place an additional stake from the casino and then continue the game.

The size of this stake depends on how many 'STEPS' have occurred.

If one or some of the players forms a 'HOUSE' after the ninth number has been introduced or from the tenth STEP to the fifteenth in the round then the croupier places a stake for those players at the casino's expense in the proportion 1 to 1 as a conditional win.

If one or some of the players forms a 'HOUSE' before the tenth STEP in the round, then the croupier places a stake for those players at the Casino's expense as a conditional win in the following portion.

| STEP at which the player forms a 'HOUSE' | Stake placed for the player at the Casino's expense |
|---|---|
| 4 | 10 to 1 |
| 5 | 8 to 1 |
| 6 | 6 to 1 |
| 7 | 5 to 1 |
| 8 | 3 to 1 |
| 9 | 2 to 1 |
| 10–15 | 1 to 1 |

If one or more players has a 'HOUSE' after fifteen steps there is no conditional win. The game continues for each round until any player has all the numbers of one or more 'LOTS' coinciding with the numbers introduced by the croupier in the course of the game in that round, but at the same time it is established that only twenty numbers in all may be taken out by the croupier during one round of the game.

After 19 STEPS have been made and 19 numbers been introduced, several different games situations can arise.

1. First situation. One or more 'LOTS' are covered, which means that the players who staked on them win.
2. Second situation. One or more LOTS. have one figure left uncovered, ie one or more players have 'HOUSES'.
3. Third situation. None of the players has even one 'HOUSE' after nineteen STEPS:

All three game situations will now be considered:

The First Situation

If at any of the STEPS (including the last nineteenth STEP) in the process of a round of the game any of the players covers all five numbers of one or more 'LOTS', this player is the winner of the round. His win is as follows:

| STEP at which a player or players has/have all five numbers coinciding with the numbers introduced | The odds applicable to the win of one stake on the last number of the 'LOT' |
|---|---|
| 5 | 50 to 1 |
| 6 | 50 to 1 |
| 7 | 25 to 1 |
| 8 | 10 to 1 |
| 9 | 5 to 1 |
| 10 to 19 | 1 to 1 |
| 20 | 1 to 1 |

If in the course of the game the player who has won the round has already received a 'conditional' win for a covered 'HOUSE', this win is also given to him and added to the main win.

The remaining (not won) stakes and conditional wins for 'HOUSES' in other LOTS or those of all other players go to the Casino's bank.

The Second Situation

If by the last nineteenth STEP none of the LOTS has been completely covered, but some payers have 'HOUSES' then at their request one additional number can be drawn, ie a twentieth prize STEP can be made.

For this the player or players who wish to play an additional STEP must place an additional stake. This is equal to the stake placed by them on the LOT plus, the sum of the 'conditional' win for each 'HOUSE' formed during the round of the game.

If the player or players agree to play an additional twentieth STEP and they have placed their respective stakes the croupier allows one of the continuing players sitting at the table to draw out a number.

If after the twentieth STEP the LOT is covered the Casino pays the winner a sum equal to the amount of the stake placed on the number plus the sum of the 'conditional' win received earlier for the 'HOUSE'. In other words the payment is made on the basis of odds of 1:1 plus the conditional win.

If after the nineteenth STEP none of the players at the table has a single LOT or a 'HOUSE' or if for any reason those who have LOTS with a 'HOUSE' do not wish to play an additional twentieth STEP, then the round is declared over and all the stakes pass to the bank of the Casino.

PLAY EQUIPMENT

Apart from the table which has already been described the equipment used in putting the game into effect will now be described.

This equipment relates to basically two activities, on the one hand those of the croupier and on the other hand those of the players.

Starting with the croupier, there are a number of ways in which firstly the sub-pool of twenty numbers, from the possible twenty five numbers available, could be created and secondly the way in which the individual numbers may be successively and randomly selected from the pool of twenty numbers.

There are many different ways of introducing these numbers depending on the construction of the table and the game equipment.

The simplest way is based on using a common pack of playing cards which the croupier puts on the table in front of the players, collects after each game and shuffles. In this case the croupier selects the 'LOTS' for each player himself.

The cards used only vary from normal playing cards in the design. Instead of the normal numbers, suits and pictures the cards have numbered barrels ranging from one barrel to five barrels.

There is one card per stake and each player can ask for seven cards. In principle any number of such cards with formal carrying any series of numbers could be used in the casino. The simplest way of introducing the numbers into the game is to use another pack of playing cards having single numbers from "1" to "25".

Other ways of introducing the numbers during the game could be more complicated. For example one method could involve selecting numbered barrels from a container 100 shown in dashed lines in FIG. 1.

The container 100 may be of various designs. It could be an originally bag or a container in the form of a relatively large barrel which may, for example roll along a special track 102 (shown in dashed lines in FIG. 1 in the table in front of the seated players, the rotation of the larger barrel shuffling the numbered small barrels contained in it.

In the game previously described there will be twenty five barrels marked with numbers from '1' to '25' respectively, although there could be other numbers of barrels.

The choice of the number of cards or barrels is determined by the need to cut downs the time taken by the game to give it the dynamism needed for casino games. The number twenty five was determined by the result of mathematical calculations to ensure fulfillment of the requirement that one round of the game should not take longer than a maximum of two and a half to three minutes.

There are many different ways in which the players themselves can select their numbers. The most convenient one is to use a pack of cards provided to each player by the casino at the beginning of each garner as an example.

The player chooses any five cards from his pack and puts them in front of himself face down. The back side of the cards are also marked with the same numbers as are drawn on the face. In this way the player and croupier can see the chosen numbers for each player in each round.

The rest of the cards in the players' pack must be put in the place 6 marked "ANTE" on the table and the stake on the top of the pack.

When all the stakes are placed the croupier declares the beginning of the round.

He must exclude from the game five cards from the pack without showing their numbers to the players. This could be done at the end of the round, but five of the twenty five cards must be excluded from the game because the round ends when nineteen from the twenty five numbers have been introduced to the players if nobody buys the twentieth step.

The case would be the same if barrels were used—five would stay in the bag or container and would not be introduced during the round.

The croupier begins by taking individual cards from his pack and places them face up in the special area 7*a* to 7*g* on the table. As indicated earlier the procedure of introducing numbers in the round is called 'making STEPS' so that each new number introduced is the next STEP.

Depending on the complexity of the accessories, the LOTS referred to earlier can be formed in various ways:

Simple Method

Each player is given cards on which all twenty five numbers are arranged five in each line and each column.

The player covers five figures on each of the cards received with transparent counters and thus selects his numbers for the game and forms LOTS from them.

Simple Random Method

The croupier bas a pack of cards with LOTS composed of five numbers already formed on them and before the beginning of the game he deals the card, turned upside down, to the players according to the number of game LOTS ordered by them.

The players lay their cards in front of them on the table and prepare to play.

Another Simple Random Method.

The croupier has a pack of cards with one number drawn on each from '1' to '25'.

The casino gives a similar pack of cards to each player, but the visible difference between the cards is that the croupiers cards are unmarked on the back side whilst the players cards are marked both on the face and back side with the same number as has been described earlier.

Each player chooses any five cards from his pack and places them in front of himself face down.

The croupier starts the round uncovering his cards one by one and displays them on the table. As soon as a player sees a match the player must expose his matching card.

More Complex Electronic Method

Each playing position at the table is equipped with a numerical keyboard with numbers zero to nine which the player uses to make up his LOTS of five numbers for the next round of the game.

After the numbers have been keyed in on the keyboard they light up oil a light or liquid crystal display in front of the player in the form of rows of numbers in LOTS, from the first to the fifth LOT. This arrangement would be like an electronic calculator.

The Most Complex Method: Radio Electronic.

Each player is given a remote control console which is a radio transmitter-receiver with a radius of operation covering the whole casino.

In this version the player can place stakes and form LOTS from a distance without needing to be at the playing table. Once the LOTS have been formed the transmission reception mode of the device is switched over so that it operates as a receiver. Each number on the barrel pulled out is transmitted to the player from the table by radio signal, allowing the player to be anywhere in the casino and at the same time take part in the game.

Stakes are placed on the game until the croupier calls out 'Les jeux sont faits'. The appropriate stake should be placed for each of the game LOT.

For example, if a player is playing for minimal stakes and one minimal stake is equal to £5 then for one LOT. the player must stake at least £5 corresponding to the numbers in the LOT.

PLACING STAKES

The procedure of placing stakes may also vary:

Simple Method

Stakes are placed in the form of transparent (or coloured) counters ('chips') which are used to cover the figures selected in the game LOT. The counter or chips are equal to varying values.

The counters may be positioned on the table in front of the cards (or in front of the individual electronic display) arranged in a pile, for example five counters on each game LOT.

The stakes could also be placed on the top of the players pack of cards after the LOT has been formed. There would be need for the pack of cards to be used again during the course of the round. Additionally this would protect the Casino from the attempts to change the numbered cards during the game round.

Complex Method

The player declares in advance the sum of money for which he is going to play and this sum is recorded electronically in the form of a credit in the name (code, password or pseudonym) of the player at the table or player with remote control console.

In this case calculation of the win and the amount of credit is done automatically for each player after each round of the game.

The design of the cards could be varied as long as the correct information is drawn on the croupier's and the players' cards.

The design of the container holding the barrels with numbers can also be varied.

It can be an ordinary bag without angles, made of close-woven non-transparent fabric, the bottom of which fits in a glove in the table when it is full, allowing the croupier to move the bag easily from player to player. The player or the croupier puts his hand in through the opening of the bag and takes one barrel out of the bag each time.

A more complex design is that of a barrel positioned on special rails laid on the table allowing it to be rolled from side to side as the croupier wishes. When the barrel rolls over the little barrels with numbers positioned inside are shuffled at random.

The open end of the barrel tracing the players is covered by a slitted diaphragm allowing a hand to be put in to pull out a little barrel but without allowing the player to see inside the large barrel.

In an extreme case the container could be a special automated lottery machine ejecting barrels during the game.

The numbers on the barrels pulled out also light up on the display positioned in the form or an ordinary upright strut next to the table or hanging on the wall in a convenient place in the casino premises for the further convenience of the player.

We claim:

1. A game comprising:

an arcuate shaped table which is provided with a croupier's station at or near a focal point of the table and a plurality of players' stations arranged around an outer periphery of the table; and two sets of playing cards, a first set for use by the croupier and a second set to be used by each player, the croupier's cards each having one side marked with a number from '1' to 'n' and an opposite side having no indication of that number and each player's card having a number between '1', and 'n' on both sides of the card.

2. A game as claimed in claim 1 wherein said table comprises a first radially outermost zone which includes said players' stations and a second zone immediately radially inwardly from said first zone and including a plurality of wager spots corresponding in number to the plurality of players' stations, each wager spot being adapted to have a respective players' wager placed on it.

3. A game as claimed in claim 2 wherein said table comprises a third zone radially inwardly from said second zone, said third zone including a plurality of spots which are associated with a conditional win, said plurality of spots in said third zone being the same number as the plurality of players' stations, each of the spots in the third zone registering with a corresponding respective spot in the second zone.

4. A game as claimed in claim 3 wherein said table includes a fourth zone radially inwardly from the third zone and comprising twenty five spots, each adapted to be covered by one of twenty five cards.

5. A game as claimed in claim 4 wherein said table includes a fifth zone radially inwardly from the fourth zone and adapted for use by the croupier.

6. A game as claimed in claim 1 in which each player's station comprises five rectangular spots which are shaped and adapted to have a playing card when placed thereon by the player.

7. A game as claimed in claim 1 in which the table is provided with a mechanism by which numbers between '1' and '25' may be selected.

8. A game as claimed in claim 1 wherein the croupier's cards each have one side marked with a number from '1' to '25' and an opposite side having no indication of that number and each player's card have a number between '1' and '25' on both sides of the card.

9. A game as claimed in claim 8 in which the marking of the number on the said one side of the croupier's and players' cards is in the form of a pictorial representation of a barrel or barrels containing the respective number.

10. A game comprising an arcuate shaped table which is provided with a croupier's station at or near a focal point of the table and a plurality of players' stations arranged around an outer periphery of the table, the table being provided with a mechanism by which numbers between '1' and 'n' may be selected, and the mechanism comprises a container which is moved along a track in order to enable the container to be brought into position opposite each player in turn to enable that player to select a number.

11. A game as claimed in claim 10 in which the container is barrel shaped.

12. A game as claimed in claim 10 in which 'n' is equal to '25'.

* * * * *